United States Patent [19]

Naser et al.

[11] Patent Number: 4,628,290

[45] Date of Patent: Dec. 9, 1986

[54] ELECTROMAGNETIC RELAY WITH ZIG-ZAG ARMATURE SPRING

[75] Inventors: Joachim Naser, Nuremberg; Olaf Schmid, Schwabach; Gerhard Schmidt, Weihenzell; Theodor Sturm, Sachsen; Berthold Walter, Oberasbach, all of Fed. Rep. of Germany

[73] Assignee: Robert Bosch GmbH, Stuttgart, Fed. Rep. of Germany

[21] Appl. No.: 745,572

[22] Filed: Jun. 17, 1985

[30] Foreign Application Priority Data

Jun. 23, 1984 [DE] Fed. Rep. of Germany ..... 3423269

[51] Int. Cl.[4] ..... H01F 7/08

[52] U.S. Cl. ..... 335/274; 335/279

[58] Field of Search ..... 335/270, 274, 276, 279

[56] References Cited

U.S. PATENT DOCUMENTS

| | | | |
|---|---|---|---|
| 2,455,690 | 12/1948 | Matthias | 335/276 |
| 3,117,255 | 1/1964 | Peterson | 335/276 X |
| 3,201,541 | 8/1965 | Richert | 335/274 X |
| 3,753,181 | 8/1973 | Thornley | 335/274 |

*Primary Examiner*—George Harris

*Attorney, Agent, or Firm*—Frishauf, Holtz, Goodman & Woodward

[57] ABSTRACT

In order to define more precisely the pivot line (25) on which the armature (17) swings about the magnet yoke (12) at its line of contact therewith, the armature restoring spring (28) is made of spring wire (29) bent into meander shape. One end of it is attached to the magnet yoke and the other to an extension (31) of the armature that extends across the pivot line. A spring clip (34) is snapped over the restoring spring and onto the sides of the magnet yoke pushes the restoring spring against the magnet yoke and opposes lengthwise shifting of the armature across the edge (32*a*) on which it is pivoted.

6 Claims, 4 Drawing Figures

27
24
22
21
19
10
11
20
18
17
16a
16
15
14
23
II
30
29
28
12
32b
26
25

30
29a
29
35
34
12
27
13
10
29b
31
17
11

12
12a
32
B
17
33
31
25
32a
13
A 34a
29
12
34
35

ELECTROMAGNETIC RELAY WITH ZIG-ZAG ARMATURE SPRING

Cross-reference to related application: Application Ser. No. 733,527, filed May 13, 1985, of the same inventors.

This invention concerns an electromagnetic relay having a base plate of insulating material for the electric connection terminals, a magnet yoke fastened thereon, a magnet winding with a core connected to the yoke and a flap-type armature on bearings such as to allow it to swing from one end thereof whilst a switch contact is provided at its other end for swinging to and from at least one fixed contact with which it cooperates. A return spring for the armature is stretched between the magnet yoke and the armature.

A known relay of the general kind just described is shown in published German Application DE-OS No. 31 48 052 in which the switching contact of the relay is fastened at one end of a leaf spring which in its middle region carries a flap-type armature and is fastened at its other end to the magnet yoke below the place where the armature is hinged. The armature in this case has one end in a cut-out constituted at a place for the pivot bearing at the end of an L-shaped magnet yoke. Lateral shoulders of the armature form a stop at the end of the magnet yoke to counteract fulcrum displacement. In the rest position of the relay the armature is lifted off the core of the winding and lies against a back contact of the relay, sometimes referred to as the rest contact.

In the construction just referred to there is a disadvantage in that the armature is not provided with a well defined pivot by the leaf springs, since on the one hand the place where the armature bears against the magnet yoke provides a pivot for the armature while on the other hand, especially when the relay opens, the armature is partly lifted by means of the place of attachment of the leaf spring to the magnet yoke. The armature is therefore partly lifted from its place of pivoting by the force of the leaf spring. In consequence a loss-producing supplementary air gap is formed in the magnet system which has an unfavorable influence on the voltage necessary to operate the relay. Furthermore, undefined rest positions for the switch contact result, with undesired greater random variation in the registry of the contacts.

SUMMARY OF THE INVENTION

It is an object of the present invention to provide a restoring spring for the armature of an electromagnetic relay of the general kind above-described such that the armature is seated on the magnet yoke for swinging, having a predetermined fully defined location both in its operated position and in its rest position.

Briefly, the restoring spring is a wire spring bent in meander shape and has one end fastened to the magnet yoke and its other end hung over a projecting extension of the armature which extends across the bearing seat of the armature.

The relay is so constituted it has the advantage that the armature restoring spring is no longer fixedly connected with the armature, so that it no longer provides a supplementary pivot point for the armature, while at the same time no additional space requirements are involved and the armature is easily mounted in place during manufacture. Furthermore, the armature is swung about a knife-shaped bearing seat at the end of the magnet yoke both when it is attracted by the relay winding and when it is magnetically released and pulled back by the restoring spring. There is the further advantage that the new type of armature restoring spring can be simply and economically manufactured and is easily replaced by another such spring. Different values of contact pressure at the rest contact of the relay can be obtained by corresponding selection of the armature restoring spring without any change to the magnet system.

It is particularly useful to apply a spring clip at the magnet yoke which is clamped over the restoring spring and presses the latter towards the magnet yoke. In that way supplementary component of force operating in the length direction of the armature on the restoring spring by which the armature is continuously pressed against the correspondingly shaped stop at the magnet yoke, a correspondingly shaped stop at the magnet yoke, prevents the armature from shifting across its bearing seat.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
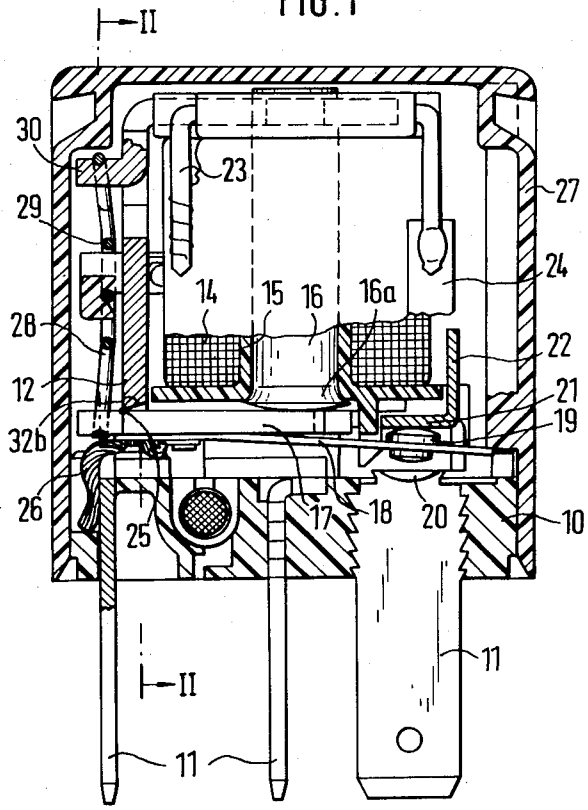
FIG. 1 is a longitudinal section on a magnified scale of an electromagnetic relay according to the invention.
Figure 2:
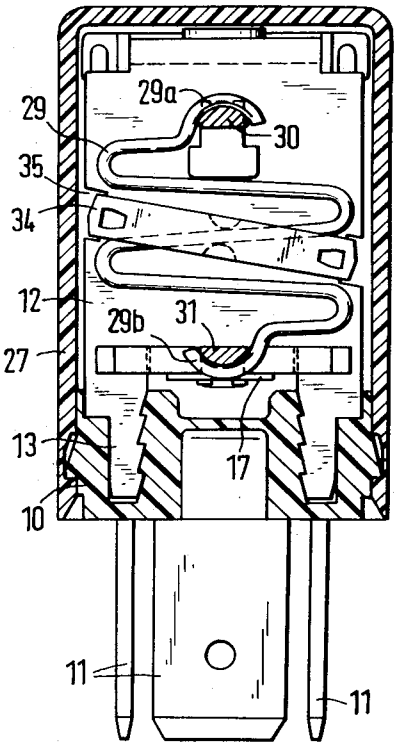
FIG. 2 is a section of the same relay on a plane indicated by the line II—II in FIG. 1.

The electromagnetic relay, of the kind for use in a motor vehicle, shown on a magnified scale in FIGS. 1 and 2 is a change-over relay having a base plate 10 of insulating material in which several flat prongs constituting the connection terminals of the relay are fixed. The base plate 10 also carries an L-shaped magnet yoke 12 which is anchored at one end by fastening tongues 13 fitting into cavities of the base plate 10. (FIG. 2).

A relay winding 14 is provided on a spool 15 which is carried by a winding core 6. The core is riveted fast at its upper end to the magnet yoke 12. A flat-type armature 17 is arranged at the lower end 16*a* of the core 16 and is pivoted to swing at one end on the magnet yoke 12. A contact spring 18 is riveted fast to the armature 17 and carries a switch contact 19 at its end projecting beyond the armature 17. The switch contact 19 cooperates with two fixed contacts, namely, the rest contact 20 which is formed by the region of a flat prong 11 lying above the base plate 10 and the operating contact 21 constituted as part of a contact carrier 22 affixed to another flat prong 11.

The ends of the relay winding 14 are each connected to a connection wire 23 affixed to the spool 15. The other ends of the two connection wires 23 are respectively welded on connection lugs 24, formed, in a manner not noticeable on the drawing, as parts of respective flat prongs 11. The contact spring 18 is welded with the end of a short copper Litz (braided) wire 26 in the region of the bearing seat 25 of the armature 17, the other end of the Litz wire being welded to the part anchored in the base plate of still another flat prong 11.

The base plate 10 is gripped by a housing 27 of insulating material surrounding the magnet system and the relay contacts. The relay is shown in FIG. 1 in its operated condition, with the armature 17 lying against the lower end of the winding core 16 and the switching contact lying against the operating fixed contact 21. In the released condition of the relay the armature, then swung by the armature restoring spring 28 into its rest position, would bring the switching contact 19 against the rest contact 20.

For obtaining a defined bearing seat 25 for the armature 17 on the magnetic yoke 12, the armature-restoring spring 28 consists of a spring wire 29 bent into meander shape with its upper end 29*a* hooked over a stamped out and bent over tongue 30 of the magnetic yoke 12 and its lower end 29*b* firmly hung on the tongue 31 of the armature 17 projecting over and beyond the bearing seat 25 of the armature on the magnetic yoke.

Figure 3:
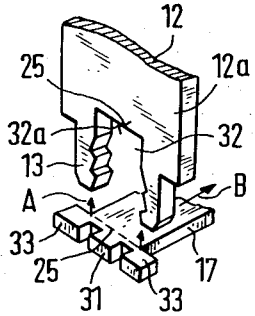
FIG. 3 shows the region of the pivot of the armature on the magnet yoke in a perspective view.

FIG. 3 shows the region of the seat 25 of the armature 17 on the lower end of the magnet yoke 12 in a perspective view just before the armature 17 is put into place during assembly. The seat or pivot 25 is formed by a rectangular cutout 32 at the lower end 12*a* of the magnet yoke 12, providing a knife or shearing edge bearing line for the armature 17 which is to be inserted in the direction of the arrow A or of the arrow B into the cutout 32, the pivot being at the base 32*a* of the cutout 32. The tongue 31 for suspending in place the restoring spring 28 is stamped out in the region of the cutout 32 from an extension of the armature 17 projecting over and beyond the bearing seat 25. The extension of the armature 17 also has outwardly reaching projections 33 on both sides of the tongue 31 which operate as stops opposing lengthwise displacement of the armature at the lower end 12*a* of the magnet yoke 12.

In order to press the armature 17 with its projections 33 continuously against the magnet yoke 12 so as to obtain a defined pivot position, a spring clip 34 is fastened to the magnet yoke 12 in the region of the restoring spring 28 so as to be tensioned over the restoring spring 28 and to press the latter against the magnet yoke 12. As can be seen from FIG. 2, the spring clip 34 is put over the spring wire 29 in the middle region of the restoring spring 28 and is clipped on both sides of the magnet yoke 12. The spring clip 34 is made of a resilient plastic and laterally guides the spring wire 29 by means of corresponding shaping as indicated by the broken lines in FIG. 2 designating features of the side of the flat spring which is away from the side directly viewed in the drawing.

Figure 4:
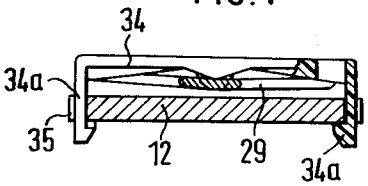
FIG. 4 shows a spring clipped on a magnet yoke in a representation which is partly in section.

It can be seen from FIG. 4 that the spring clip 34 snaps around the magnet yoke 12 in a manner that permits some limited shifting of its position, by means of hook-shaped ends 34*a* fitting into two lateral cutouts 35 of the magnet yoke 12, the shape of which appears in FIG. 2. The armature restoring spring 28 bent towards the magnet yoke 12 by the spring clip 34 produces a component of force effective in the axis direction of the armature 17 which presses the armature 17 and its projections 33 continuously against the magnet yoke 12. It is thereby assured that even in the case of axial displacement of the armature 17 to the rear, which is occasionally possible as the result of heavy shaking or shocks, the armature 17 immediately, or at least after a few switching operations, will be pressed back into the correct position. The dimensioning of the relay with regard to contact pressure, contact erosion reserve and switching stroke or play is substantially improved by the provision of a defined pivot location. The sharp edge seat of the armature 17 on the magnet yoke 12 is assured by the fact that the base 32*a* of the cutout 32 is made sufficiently oblique so that the outer edge of the base surface 32*a* of the cutout 32 projects slightly more towards the armature 17 than the inner edge, as can be seen in FIG. 1 by the oblique profile 32*b* there shown.

Although the invention has been described with reference to a particular illustrative and preferred embodiment, it will be understood that modifications and variations are possible within the inventive concept.

It should be added that other constructional details of the relay shown are further described and explained in our co-pending application Ser. No. 733,527, filed on May 13, 1985 the contents of which are hereby incorporated by reference.

We claim:

1. Electromagnetic relay comprising an inverted-L magnet yoke upstanding from a base of insulation material through which pass connection prongs fixed in said base, an electromagnet core extending from said yoke towards said base having a winding spool and a winding in said spool supported so as to encircle said core, said yoke (12) having a bearing seat aligned substantially parallel to said base for an armature, near its attachment to said base;

a substantially flat armature of a configuration enabling it to swing in a space between said core and said base about said bearing seat on said yoke (12), having a portion extending in a first direction from said bearing seat towards the side of said relay remote from said armature bearing seat and a portion extending in a second direction substantially opposite to said first direction across and beyond said bearing seat;

a switch contact resiliently mounted on said armature so as to move in a path near said side of said relay remote from said armature bearing seat;

at least one fixed contact mounted for cooperation with said switch contact, and a spring for returning said armature to its state of rest, in the form of a spring wire (29) bent into meander shape (28), connected at one end to said magnet yoke (12) and at the other end to said armature portion (31) extending in said second direction across said bearing seat.

2. Relay according to claim 1, in which said magnet yoke has a cutout (32) at its end (12*a*) affixed to said base which is substantially rectangular in shape with a boundary (32*a*) directed across said yoke which provides said bearing seat (25) for said armature (17).

3. Relay according to claim 2, in which said portion (31) of said armature (17) extending across and beyond said bearing seat comprises a tongue (31) for hooking on or otherwise attaching said armature returning spring (28) and projections (33) laterally spaced from said tongue (31) serving as stops preventing lengthwise shift of said armature (17) across its bearing seat (25).

4. Relay according to claim 3, in which a spring clip (34) attached to said magnet yoke (12) at its ends is stretched across said armature return spring (28) for pressing said armature return spring (28) towards said magnet yoke (12).

5. Relay according to claim 4, in which said spring clip (34) is made of a resilient plastic material and is clipped onto said magnet yoke (12).

6. Relay according to claim 5, in which said spring clip (34) lies across a mid-portion of said armature return spring (28) and is snapped on to said magnet yoke with hook-shaped ends (34*a*) passing through respective lateral cutouts (35) of said magnet yoke having a configuration permitting a limited shifting of position of said clip.

* * * * *